US011713756B2

(12) United States Patent
Kim et al.

(10) Patent No.: US 11,713,756 B2
(45) Date of Patent: Aug. 1, 2023

(54) SCROLL COMPRESSOR

(71) Applicant: LG Electronics Inc., Seoul (KR)

(72) Inventors: Taekyoung Kim, Seoul (KR); Sungyong Ahn, Seoul (KR); Jaeha Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/342,168

(22) Filed: Jun. 8, 2021

(65) Prior Publication Data

US 2022/0056908 A1 Feb. 24, 2022

(30) Foreign Application Priority Data

Aug. 19, 2020 (KR) ..... 10-2020-0104158

(51) Int. Cl.

| | |
|---|---|
| ***F04C 18/02*** | (2006.01) |
| ***F04C 2/02*** | (2006.01) |
| ***F04C 15/00*** | (2006.01) |
| ***F04C 29/12*** | (2006.01) |
| ***F04C 23/00*** | (2006.01) |
| ***F04C 29/02*** | (2006.01) |

(52) U.S. Cl.

CPC ..... *F04C 2/025* (2013.01); *F04C 15/0088* (2013.01); *F04C 18/0215* (2013.01); *F04C 23/008* (2013.01); *F04C 29/02* (2013.01); *F04C 29/12* (2013.01); *F04C 2240/30* (2013.01)

(58) Field of Classification Search

None

See application file for complete search history.

(56) References Cited

U.S. PATENT DOCUMENTS

| | | | | |
|---|---|---|---|---|
| 6,398,520 | B2 * | 6/2002 | Han | F04C 29/061 |
| 2013/0129549 | A1 * | 5/2013 | Sakuda | F04C 29/065 |

FOREIGN PATENT DOCUMENTS

| | | | | |
|---|---|---|---|---|
| EP | 2221483 | A2 * | 8/2010 | F04C 23/001 |
| JP | 03225094 | A * | 10/1991 | F04C 18/02 |
| JP | 06241178 | A * | 8/1994 | F04C 18/02 |
| JP | 2017150349 | | 8/2017 | |
| JP | 2017150349 | A * | 8/2017 | F04C 15/0088 |
| KR | 1019970045477 | | 7/1997 | |
| KR | 20060119318 | | 11/2006 | |
| KR | 20190131787 | | 11/2019 | |

OTHER PUBLICATIONS

Office Action in Korean Appln. No. 10-2020-0104158, dated Sep. 24, 2021, 12 pages (with English translation).

* cited by examiner

*Primary Examiner* — Devon C Kramer
*Assistant Examiner* — Wesley G Harris
(74) *Attorney, Agent, or Firm* — Fish & Richardson P.C.

(57) ABSTRACT

A scroll compressor includes oil in an oil storage space that is brought into direct contact with and stirred with a discharge refrigerant. The scroll compressor includes a fixed scroll, an orbiting scroll coupled to one side of the fixed scroll, and a discharge cover coupled to another side of the fixed scroll and provided with a muffler hole communicating with a refrigerant discharge space and the oil storage space.

7 Claims, 10 Drawing Sheets

SCROLL COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2020-0104158, filed on Aug. 19, 2020, the contents of which is incorporated by reference herein in its entirety.

TECHNICAL FIELD

The present disclosure relates to a scroll compressor, and more particularly, to a scroll compressor in which oil in an oil storage space is in direct contact and stirred with a discharge refrigerant.

BACKGROUND

A compressor refers to a device that compresses a fluid to discharge a high-pressure fluid or operates a machine by using energy generated when the high-pressure fluid is discharged.

Among various types of compressors, a scroll compressor compresses a refrigerant fluid flowing between a fixed scroll and an orbiting scroll and discharges the compressed refrigerant in a high-pressure state from a discharge space.

In detail, the orbiting scroll performs an orbiting motion relative to the fixed scroll, such that the refrigerant fluid introduced between the fixed scroll and the orbiting scroll is compressed. The compressed refrigerant fluid then passes through the discharge space to be discharged to outside of the scroll compressor.

At this time, oil is supplied between components that make a rotational motion, so that the rotational motion of each component is smoothly carried out.

The oil is supplied to bearings or a compression unit of the scroll compressor from an oil storage space provided in the scroll compressor, and then returns to the oil storage space. Such a process is repeatedly performed to circulate the oil in the scroll compressor.

When the scroll compressor is initially started, both a low-temperature oil and a liquid refrigerant may be supplied to the oil storage space.

In this case, since the low-temperature oil has low viscosity, there is a possibility that the components that perform the rotational motion may not be sufficiently lubricated.

In addition, when a temperature of the oil storage space is increased while the liquid refrigerant is excessively introduced into the oil storage space, the refrigerant may be instantaneously vaporized.

Accordingly, a water level of a mixed fluid of the refrigerant and oil in the oil storage space may be momentarily excessively lowered. When the water level of the mixed fluid is lower than a lower end of an oil supply pipe, it may be difficult for oil to be supplied to the bearings or compression unit.

In summary, when the scroll compressor is initially started, the bearings or the compression unit may not be sufficiently lubricated by the oil and thereby be damaged during the rotational motion.

Accordingly, development of a scroll compressor capable of preventing oil with low viscosity from being supplied to the bearings and compression unit may be considered.

Some compressors include an oil temperature inside an oil storage space that is adjusted by a refrigerant flow path passing through the oil storage space.

However, this type of compressor requires a separate pipe branched from a refrigerant pipe to adjust the temperature of the oil. This may cause the scroll compressor to have a more complicated structure and a manufacturing process of the scroll compressor to be increased. Furthermore, production and maintenance costs of the scroll compressor may be further increased.

Some lubricating oil heating apparatuses for a compressor are configured for heating lubricating oil through a pipe of a refrigerant discharge pipe extending up to a lubricating oil storage chamber is disclosed.

However, this type of heating apparatus also requires a separate branch pipe for heating the oil. This may result in making the structure of the scroll compressor more complicated, more increasing a manufacturing process, and more increasing production and maintenance costs.

SUMMARY

One aspect of the present disclosure is to provide a scroll compressor in which oil inside an oil storage space is in direct contact and stirred with a discharge refrigerant.

Another aspect of the present disclosure is to provide a scroll compressor capable of preventing oil from being supplied in a low viscosity state.

Another aspect of the present disclosure is to provide a scroll compressor in which an oil temperature in an oil storage space is adjustable and simultaneously a separate pipe branched from a refrigerant pipe is not used.

Another aspect of the present disclosure is to provide a scroll compressor that operates at an oil circulation ratio (OCR) optimized for a preset operation condition.

In order to achieve these and other advantages and in accordance with the purpose of this specification, particular implementations of the present disclosure provide a scroll compressor that includes a fixed scroll, an orbiting scroll, a discharge cover, and a casing. The orbiting scroll is disposed at a first side of the fixed scroll and configured to perform an orbiting motion relative to the fixed scroll and define a compression chamber between the orbiting scroll and the fixed scroll. The discharge cover is disposed at a second side of the fixed scroll that is opposite to the first side of the fixed scroll. The casing extends in a first direction and accommodates the fixed scroll, the orbiting scroll, and the discharge cover. The discharge cover includes a cover bottom surface, a cover side portion extending from the cover bottom surface toward the fixed scroll, and a discharge space defined by the cover bottom surface, the cover side portion, and the fixed scroll. The cover bottom surface and an inner circumferential surface of the casing are spaced apart from each other and define an oil storage space between the cover bottom surface and the casing. The cover bottom surface defines a muffler hole that is in fluid communication with the discharge space and the oil storage space.

In some implementations, the scroll compressor can optionally include one or more of the following features. The cover bottom surface may be coupled with an oil feeder at a side of the cover bottom surface that is opposite to the fixed scroll. The oil feeder may extend away from the fixed scroll. The muffler hole may be disposed between an outer circumference of the oil feeder and an outer circumferential surface of the cover bottom surface. The muffler hole may extend in the first direction. The scroll compressor may include a refrigerant guide member disposed at a side of the cover bottom surface that is opposite to the fixed scroll and adjacent to the muffler hole. The refrigerant guide member may extend in the first direction to overlap the muffler hole and be configured to cause a refrigerant passing through the muffler hole to contact the refrigerant guide member. The muffler hole may extend in a second direction different from the first direction. The scroll compressor may include a refrigerant guide member disposed at a side of the cover bottom surface that is opposite to the fixed scroll and adjacent to the muffler hole. The refrigerant guide member may extend in the second direction to overlap the muffler hole and be configured to cause a refrigerant passing through the muffler hole to contact with the refrigerant guide member. The muffler hole may have a circular cross section that extends in a predetermined direction. The circular cross section may have a diameter of 0.5 mm or greater. The cover bottom surface may define a plurality of muffler holes that are spaced apart from each other.

Particular implementations of the present disclosure provide a scroll compressor that includes a fixed scroll, an orbiting scroll, a discharge cover, and a casing. The fixed scroll includes a fixed wrap. The orbiting scroll is disposed at a first side of the fixed scroll and configured to perform an orbiting motion relative to the fixed scroll and define a compression chamber between the orbiting scroll and the fixed scroll. The orbiting scroll includes an orbiting wrap configured to engage with the fixed wrap. The discharge cover is disposed at a second side of the fixed scroll that is opposite to the first side of the fixed scroll. The casing extends in a first direction and accommodates the fixed scroll, the orbiting scroll, and the discharge cover. The discharge cover may include a cover bottom surface, a cover side portion extending from the cover bottom surface toward the fixed scroll, and a discharge space defined by the cover bottom surface, the cover side portion, and the fixed scroll. The cover bottom surface and an inner circumferential surface of the casing are spaced apart from each other and define an oil storage space between the cover bottom surface and the casing. A muffler hole is defined through a connection portion between the cover bottom surface and the cover side portion. The muffler hole is in fluid communication with the discharge space and the oil storage space.

In some implementations, the scroll compressor can optionally include one or more of the following features. The scroll compressor may include a refrigerant guide member disposed at a side of the cover bottom surface that is opposite to the fixed scroll and adjacent to the muffler hole. The refrigerant guide member may extend toward a radially outer side of the cover side portion and be configured to cause a refrigerant passing through the muffler hole to contact the refrigerant guide member. The scroll compressor may include a refrigerant guide member disposed at an outer circumferential surface of the cover side portion adjacent to the muffler hole. The refrigerant guide member may extend toward the oil storage space and be configured to cause a refrigerant passing through the muffler hole to contact the refrigerant guide member. The scroll compressor may include a refrigerant guide member disposed at an outer circumferential surface of the cover side portion adjacent to the muffler hole. The refrigerant guide member may extend in a same direction as a direction that the muffler hole extends. The muffler hole may have a circular cross section that extends in a predetermined direction. The circular cross section may have a diameter of 0.5 mm or greater. The scroll compressor may include a plurality of muffler holes that are spaced apart from each other at the connection portion between the cover bottom surface and the cover side portion.

Particular implementations of the present disclosure provide a scroll compressor that includes a fixed scroll, an orbiting scroll, a discharge cover, and a casing. The orbiting scroll is disposed at a first side of the fixed scroll and configured to perform an orbiting motion relative to the fixed scroll. The orbiting scroll is configured to be coupled to the fixed scroll and define a compression chamber with the fixed scroll. The discharge cover is disposed at a second side of the fixed scroll that is opposite to the first side of the fixed scroll. The casing extends in a first direction and defines a space for accommodating the fixed scroll, the orbiting scroll, and the discharge cover. The discharge cover may include a cover bottom surface, a cover side portion extending from the cover bottom surface toward the fixed scroll and being spaced apart from an inner circumferential surface of the casing, and a discharge space defined by the cover bottom surface, the cover side portion, and the fixed scroll. The cover bottom surface and an inner circumferential surface of the casing are spaced apart from each other and define an oil storage space between the cover bottom surface and the casing. The cover side portion defines a muffler hole that is in fluid communication with the discharge space and the oil storage space.

In some implementations, the scroll compressor can optionally include one or more of the following features. The muffler hole may extend in a radial direction of the cover side portion. The scroll compressor may include a refrigerant guide member disposed at an outer circumferential surface of the cover side portion adjacent to the muffler hole. The refrigerant guide member may extend in a radial direction of the cover side portion to overlap the muffler hole and be configured to cause a refrigerant passing through the muffler hole to contact with the refrigerant guide member. The scroll compressor may include a refrigerant guide member disposed at an outer circumferential surface of the cover side portion adjacent to the muffler hole. The refrigerant guide member may extend in a same direction as a direction that the muffler hole extends. The muffler hole may extend in a second direction different from the first direction. The scroll compressor may include a refrigerant guide member disposed at an outer circumferential surface of the cover side portion adjacent to the muffler hole. The refrigerant guide member may extend in the second direction to overlap the muffler hole and be configured to cause a refrigerant passing through the muffler hole to contact the refrigerant guide member. The muffler hole may have a circular cross section that extends in a predetermined direction. The muffler hole may have a diameter of 0.5 mm or greater. The scroll compressor may have a plurality of muffler holes that are defined at the cover side portion and spaced apart from each other.

In order to achieve these and other advantages and in accordance with the purpose of this specification, as embodied and broadly described herein, there is provided a scroll compressor, including a fixed scroll, an orbiting scroll configured to perform an orbiting motion relative to the fixed scroll and coupled to one side of the fixed scroll to define a compression chamber, a discharge cover coupled to another side of the fixed scroll opposite to the one side, and a casing extending in one direction and configured to accommodate therein the fixed scroll, the orbiting scroll, and the discharge cover. The discharge cover may include a cover bottom surface, a cover side portion extending from the cover bottom surface toward the fixed scroll, and a discharge space that is a space defined by being surrounded by the cover bottom surface, the cover side portion, and the fixed scroll. The cover bottom surface and an inner circumferential surface of the casing may be spaced apart from each other to define an oil storage space between the cover bottom surface and the casing. The cover bottom surface may be provided with a muffler hole formed therethrough to communicate with the discharge space and the oil storage space.

The cover bottom surface may be coupled with an oil feeder extending in a direction opposite to the fixed scroll at one side thereof opposite to the fixed scroll, and the muffler hole may be disposed between an outer circumference of the oil feeder and an outer circumferential surface of the cover bottom surface.

The muffler hole may extend in the one direction.

The scroll compressor may further include a refrigerant guide member disposed on one side of the cover bottom surface, opposite to the fixed scroll, to be adjacent to the muffler hole, and extending to overlap the muffler hole in the one direction such that a refrigerant passing through the muffler hole collides therewith.

The muffler hole may extend in a direction different from the one direction.

The scroll compressor may further include a refrigerant guide member disposed on one side of the cover bottom surface, opposite to the fixed scroll, to be adjacent to the muffler hole, and extending to overlap the muffler hole in the different direction, such that a refrigerant passing through the muffler hole collides therewith.

The muffler hole may be formed such that a circular cross section having a diameter of 0.5 mm or more extends in a predetermined direction.

The cover bottom surface may be provided with a plurality of muffler holes spaced apart from each other.

In addition, a scroll compressor according to another implementation may include a fixed scroll provided with a fixed wrap, an orbiting scroll configured to perform an orbiting motion relative to the fixed scroll, coupled to one side of the fixed scroll to define a compression chamber, and provided with an orbiting wrap engaged with the fixed wrap, a discharge cover coupled to another side of the fixed scroll, opposite to the one side, and a casing extending in one direction and configured to accommodate therein the fixed scroll, the orbiting scroll, and the discharge cover. The discharge cover may include a cover bottom surface, a cover side portion extending from the cover bottom surface toward the fixed scroll, and a discharge space that is a space defined by being surrounded by the cover bottom surface, the cover side portion, and the fixed scroll. The cover bottom surface and an inner circumferential surface of the casing may be spaced apart from each other to define an oil storage space between the cover bottom surface and the casing. A muffler hole communicating with the discharge space and the oil storage space may be formed through a connection portion between the cover bottom surface and the cover side portion.

The scroll compressor may further include a refrigerant guide member disposed on one side of the cover bottom surface, opposite to the fixed scroll, to be adjacent to the muffler hole, and extending to a radially outer side of the cover side portion, such that a refrigerant passing through the muffler hole collides therewith.

The scroll compressor may further include a refrigerant guide member disposed on an outer circumferential surface of the cover side portion to be adjacent to the muffler hole, and extending toward the oil storage space such that a refrigerant passing through the muffler hole collides therewith.

The scroll compressor may further include a refrigerant guide member disposed on an outer circumferential surface of the cover side portion to be adjacent to the muffler hole, and extend in the same direction as a direction that the muffler hole extends.

The muffler hole may be formed such that a circular cross section having a diameter of 0.5 mm or more extends in a predetermined direction.

The muffler hole may be provided in plurality on the connection portion between the cover bottom surface and the cover side portion.

A scroll compressor according to still another implementation may further include a fixed scroll, an orbiting scroll disposed at one side of the fixed scroll and coupled to the fixed scroll so as to form a compression chamber together with the fixed scroll, and performing an orbiting motion relative to the fixed scroll, a discharge cover coupled to another side of the fixed scroll opposite to the one side, and a casing extending in one direction and defining a space for accommodating therein the fixed scroll, the orbiting scroll, and the discharge cover. The discharge cover may include a cover bottom surface, a cover side portion extending from the cover bottom surface toward the fixed scroll and spaced apart from an inner circumferential surface of the casing, and a discharge space that is a space defined by being surrounded by the cover bottom surface, the cover side portion, and the fixed scroll. The cover bottom surface and an inner circumferential surface of the casing may be spaced apart from each other to define an oil storage space between the cover bottom surface and the casing. The cover side portion may be provided a muffler hole formed therethrough to communicate with the discharge space and the oil storage space.

The muffler hole may extend in a radial direction of the cover side portion.

The scroll compressor may further include a refrigerant guide member disposed on an outer circumferential surface of the cover side portion to be adjacent to the muffler hole, and extending in a radial direction of the cover side portion to overlap the muffler hole such that a refrigerant passing through the muffler hole collides therewith.

The scroll compressor may further include a refrigerant guide member disposed on an outer circumferential surface of the cover side portion to be adjacent to the muffler hole, and extending in the same direction as a direction that the muffler hole extends.

The muffler hole may extend in a direction different from the one direction.

The scroll compressor may further include a refrigerant guide member disposed on an outer circumferential surface of the cover side portion to be adjacent to the muffler hole, and extending to overlap the muffler hole in the different direction such that a refrigerant passing through the muffler hole collides therewith.

The muffler hole may have a circular cross section having a diameter of 0.5 mm or more and extend in a predetermined direction.

The muffler hole provided on the cover bottom surface may be provided in plurality spaced apart from each other.

Among various effects of the present disclosure, the following effects may be obtained through the above-described technical solution.

First, a muffler hole that communicates with a discharge space and an oil storage space may be formed through a discharge cover.

Accordingly, a refrigerant collected in the discharge space may be moved to the oil storage space through the muffler hole. The oil in the oil storage space can thus be brought into direct contact with and stirred with a discharge refrigerant.

This may result in rapidly increasing a temperature of the oil in the oil storage space at the beginning of an operation of a scroll compressor.

In addition, by virtue of the rapid increase in the temperature of the oil in the oil storage space, such oil can be prevented from being supplied in a low viscosity state.

This may result in preventing damage on bearings and lowering of an oil level.

In addition, since the oil inside the oil storage space is in direct contact with and stirred with the discharge refrigerant, a separate pipe branched from a refrigerant pipe may not be used and simultaneously the temperature of the oil in the oil storage space can be adjusted.

Accordingly, the scroll compressor can have a more simplified structure, and its manufacturing process can be further reduced.

In addition, production and maintenance costs of the scroll compressor can be reduced.

The number and size of the muffler hole provided on the discharge cover can be adjusted according to a preset operation condition.

Accordingly, the scroll compressor can be operated at an Oil Circulation Ratio (OCR) optimized for a preset operation condition.

DETAILED DESCRIPTION

Hereinafter, a scroll compressor 10 according to an implementation of the present disclosure will be described in more detail with reference to the accompanying drawings.

In the following description, a description of some components may be omitted to clarify features of the present disclosure.

For the sake of brief description with reference to the drawings, the same or equivalent components may be provided with the same or similar reference numbers, and description thereof will not be repeated.

It should be noted that the attached drawings are provided to facilitate understanding of the embodiments disclosed in this specification, and should not be construed as limiting the technical idea disclosed in this specification by the attached drawings.

Figure 1:
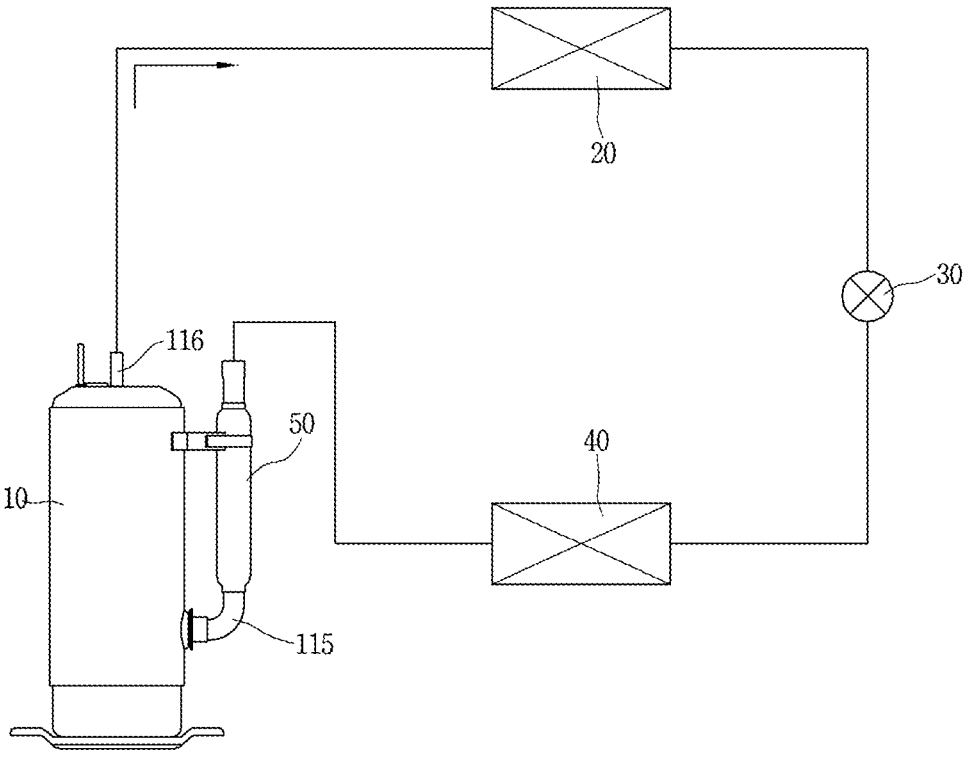
FIG. 1 is a schematic diagram illustrating a refrigeration cycle device including a scroll compressor in accordance with an implementation of the present disclosure.

Hereinafter, a scroll compressor 10 according to an implementation of the present disclosure will be described with reference to FIGS. 1 and 2.

A refrigeration cycle device including the scroll compressor 10 according to the present disclosure may be configured such that the scroll compressor 10, a condenser 20, an expansion apparatus 30, and an evaporator 40 form a closed loop.

The condenser 20, the expansion apparatus 30, and the evaporator 40 may be sequentially connected to a refrigerant discharge pipe 116 of the scroll compressor 10. Also, a discharge side of the evaporator 40 may be connected to a suction side of the scroll compressor 10.

One side of a refrigerant suction pipe 115 may be connected to an accumulator 50. In addition, the accumulator 50 may be connected to an outlet side of the evaporator 40 through a refrigerant pipe.

Accordingly, while a refrigerant flows from the evaporator 40 to the accumulator 50, a liquid refrigerant may be separated in the accumulator 50, and only a gaseous refrigerant may be directly introduced into a compression chamber through the refrigerant suction pipe 115.

Accordingly, the refrigerant compressed in the scroll compressor 10 may be discharged toward the condenser 20, and then sucked back into the scroll compressor 10 sequentially through the expansion apparatus 30 and the evaporator 40. The series of processes may be repeatedly carried out.

The scroll compressor 10 may include a casing 110 having an inner space for accommodating a driving motor 120, a main frame 130, an orbiting scroll 150, a fixed scroll 140, and a discharge cover 160.

In detail, the driving motor 120 may be disposed in an upper portion of the casing 110, and the main frame 130, the orbiting scroll 150, the fixed scroll 140, and the discharge cover 160 may be sequentially disposed below the driving motor 120.

The driving motor 120 may configure a motor unit that converts external electrical energy into mechanical energy.

In addition, the main frame 130, the orbiting scroll 150, the fixed scroll 140, and the discharge cover 160 may configure a compression unit that compresses a refrigerant by receiving the mechanical energy generated in the driving motor 120.

The motor unit may be coupled to an upper end of a rotating shaft 125 to be explained later, and the compression unit may be coupled to a lower end of the rotating shaft 125. That is, the scroll compressor 10 may have a lower compression type structure.

In summary, the scroll compressor 10 may include the motor unit and the compression unit, and the motor unit and the compression unit may be accommodated in an inner space 110*a* of the casing 110.

The casing 110 may include a cylindrical shell 111, an upper shell 112 and a lower shell 113.

The cylindrical shell 111 may be formed in a cylindrical shape with both ends open.

The upper shell 112 may be coupled to an upper end portion of the cylindrical shell 111. In addition, the lower shell 113 may be coupled to a lower end portion of the cylindrical shell 111.

That is, both the upper and lower end portions of the cylindrical shell 111 may be coupled to the upper shell 112 and the lower shell 113, respectively, in a covering manner. The cylindrical shell 111, the upper shell 112 and the lower shell 113 that are coupled together may define the inner space 110*a* of the casing 110. At this time, the inner space 110*a* may be sealed.

The sealed inner space 110*a* of the casing 110 may be divided into a lower space S1, an upper space S2, an oil storage space S3, and a discharge space S4.

The lower space S1 and the upper space S2 may be defined above the main frame 130 and the oil storage space S3 and the discharge space S4 may be defined below the main frame 130.

The lower space Si may indicate a space defined between the driving motor 120 and the main frame 130, and the upper space S2 may indicate a space above the driving motor 120. In addition, the oil storage space S3 may indicate a space below the discharge cover 160, and the discharge space S4 may indicate a space defined between the discharge cover 160 and the fixed scroll 140.

A refrigerant discharged to the discharge space S4 may flow to the lower space S1.

One end of the refrigerant suction pipe 115 may be coupled through a side surface of the cylindrical shell 111. Specifically, the one end of the refrigerant suction pipe 115 may be coupled through the cylindrical shell 111 in a radial direction of the cylindrical shell 111.

The refrigerant suction pipe 115 may penetrate through the cylindrical shell 111 to be directly coupled to a suction through hole 142*c* of the fixed scroll 140. Accordingly, the refrigerant may be introduced into a compression chamber through the refrigerant suction pipe 115.

The accumulator 50 may be coupled to another end, different from the one end, of the refrigerant suction pipe 115.

The accumulator 50 may be connected to an outlet side of the evaporator 40 through a refrigerant pipe. Accordingly, while a refrigerant flows from the evaporator 40 to the accumulator 50, a liquid refrigerant may be separated in the accumulator 50, and only a gaseous refrigerant may be directly introduced into a compression chamber through the refrigerant suction pipe 115.

A refrigerant discharge pipe 116 may be coupled through a top of the upper shell 112 to communicate with the inner space 110*a* of the casing 110. Accordingly, the refrigerant discharged from the compression unit into the inner space 110*a* of the casing 110 may be discharged to the condenser 20 through the refrigerant discharge pipe 116.

The driving motor 120 may be disposed at an upper portion in the inner space 110*a* of the casing 110.

The driving motor 120 may include a stator 121 and a rotor 122.

The stator 121 may be fixedly inserted into an inner circumferential surface of the cylindrical shell 111, and the rotor 122 may be rotatably disposed in the stator 121.

The stator may include a stator core 1211 and a stator coil 1212.

The stator core 1211 may be formed in a cylindrical shape, and may be shrink-fitted to the inner circumferential surface of the cylindrical shell 111.

A plurality of recessed surfaces may be formed in a D-cut shape on an outer circumferential surface of the stator core 1211 along an axial direction.

The stator coil 1212 may be wound around the stator core 1211 and may be electrically connected to an external power source through a terminal (not shown) that is coupled through the casing 110.

An insulator 1213 made of an electrically insulating material may be inserted between the stator core 1211 and the stator coil 1212.

The rotor 122 may be rotatably provided inside the stator core 1211.

The rotor 122 may include a rotor core 1221 and permanent magnets 1222.

The rotor core 1221 may be formed in a cylindrical shape and may be accommodated in a space formed in a central portion of the stator core 1211.

Specifically, the rotor core 1221 may be rotatably inserted into the space formed in the central portion of the stator core 1211 with a preset gap from an inner side (inner surface) of the stator core 1211.

The permanent magnets 1222 may be embedded in the rotor core 1221 at preset intervals along a circumferential direction.

In one implementation, a balance weight 123 may be coupled to a lower end of the rotor core 1221.

In another implementation, the balance weight 123 may be coupled to a shaft portion 1251 of the rotating shaft 125 to be described later.

The rotating shaft 125 may be coupled to the center of the rotor 122.

An upper end portion of the rotating shaft 125 may be press-fitted into the rotor 122, and a lower end portion may be rotatably inserted into the main frame 130 to be supported in a radial direction.

The main frame 130 may be provided with a main bearing 171 configured as a bush bearing to support the lower end portion of the rotating shaft 125. Accordingly, a portion, which is inserted into the main frame 130, of the lower end portion of the rotating shaft 125 may smoothly rotate inside the main frame 130.

The rotating shaft 125 may transfer a rotational force of the driving motor 120 to the orbiting scroll 150 constituting the compression unit. Then, the orbiting scroll 150 which is eccentrically coupled to the rotating shaft 125 may perform an orbiting motion with respect to the first scroll 140.

The rotating shaft 125 may include a shaft portion 1251, a first bearing portion 1252, a second bearing portion 1253, and an eccentric portion 1254.

The shaft portion 1251 may be an upper portion of the rotating shaft 125 and may be formed in a cylindrical shape.

The shaft portion 1251 may be partially press-fitted into the rotor 122.

The first bearing portion 1252 may be a portion extending from a lower end the shaft portion 1251.

The first bearing portion 1252 may be inserted into a main bearing hole 133*a* of the main frame 130 to be described later so as to be supported in the radial direction.

The second bearing portion 1253 may be a lower portion of the rotating shaft 125.

The second bearing portion 1253 may be inserted into the fixed scroll 140 to be described later so as to be supported in the radial direction.

A central axis of the second bearing portion 1253 and a central axis of the first bearing portion 1252 may be aligned on the same line. That is, the first bearing portion 1252 and the second bearing portion 1253 may have the same central axis.

The eccentric portion 1254 may be formed between a lower end of the first bearing portion 1252 and an upper end of the second bearing portion 1253.

The eccentric portion 1254 may be inserted into a rotating shaft coupling portion 153 of the orbiting scroll 150 to be described later.

The eccentric portion 1254 may be eccentric with respect to the first bearing portion 1252 or the second bearing portion 1253 in the radial direction. That is, the central axis of the first bearing portion 1252 and the second bearing portion 1253 and a central axis of the eccentric portion 1254 may be inconsistent (not be aligned on the same line).

Meanwhile, an oil supply passage 126 for supplying oil to the first bearing portion 1252, the second bearing portion 1253, and the eccentric portion 1254 may be formed in the rotating shaft 125.

An oil feeder 127 for pumping up oil filled in the oil storage space S3 may be coupled to the lower end of the rotating shaft 125, namely, a lower end of the second bearing portion 1253.

The oil feeder 127 may extend from one side of a cover bottom surface 1611, opposite to the fixed scroll 140, in a direction opposite to the fixed scroll 140.

The oil feeder 127 may include an oil suction pipe 1271 and a blocking member 1272.

The oil suction pipe 1271 may be insertedly coupled to the oil supply passage 126 of the rotating shaft 125. In addition, the oil suction pipe 1271 may be coupled through the discharge cover 160.

The oil suction pipe 1271 may extend downward so that a lower end portion thereof is immersed in the oil in the oil storage space S3.

The blocking member 1272 may accommodate the oil suction pipe 1271 to block an introduction of foreign substances.

Figure 3:
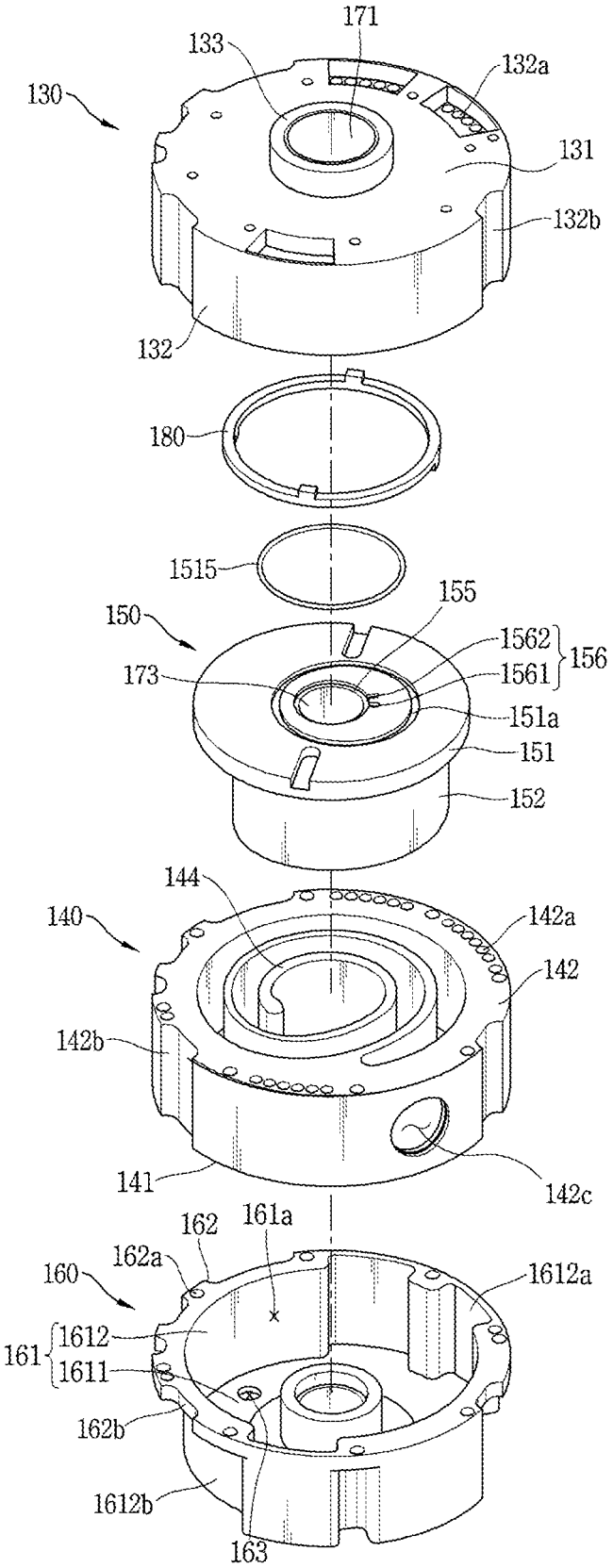
FIG. 3 is an exploded perspective view illustrating components of a compression unit of FIG. 2, viewed from the top.
Figure 4:
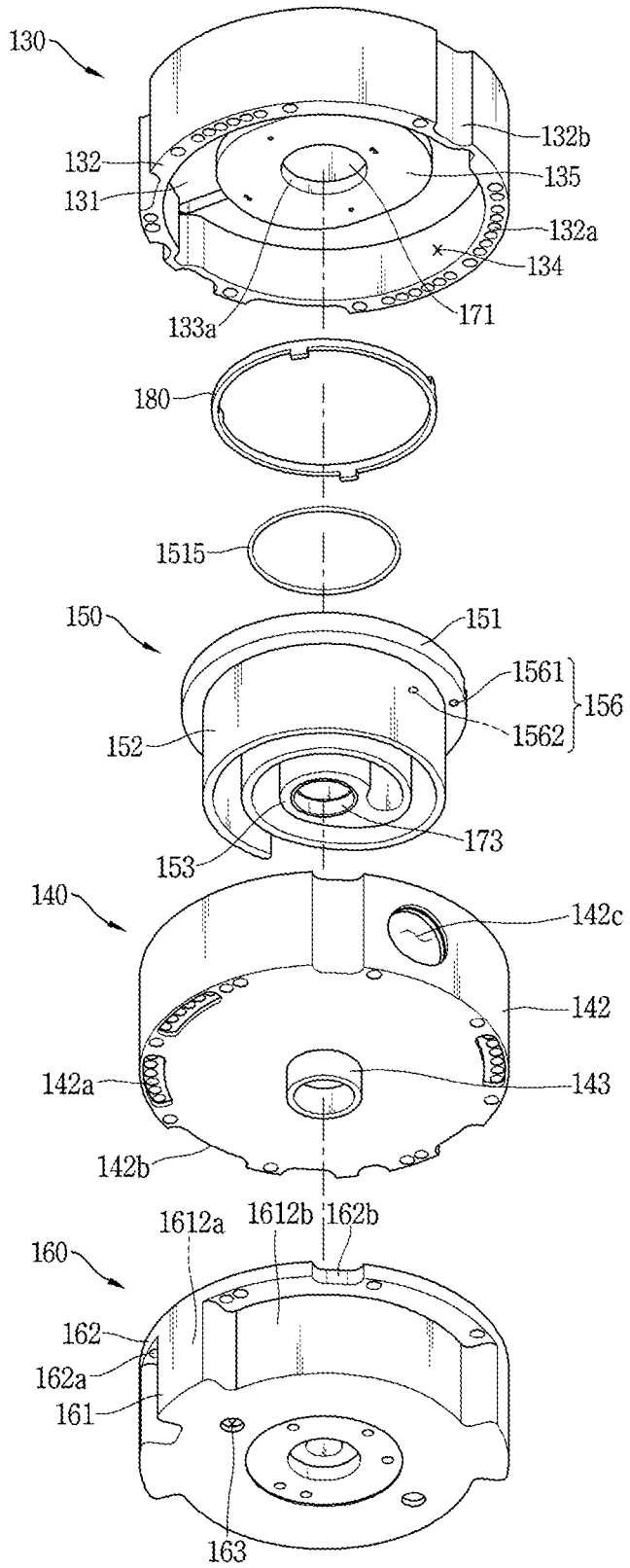
FIG. 4 is an exploded perspective view illustrating the components of the compression unit of FIG. 2, viewed from the bottom.
Figure 5:
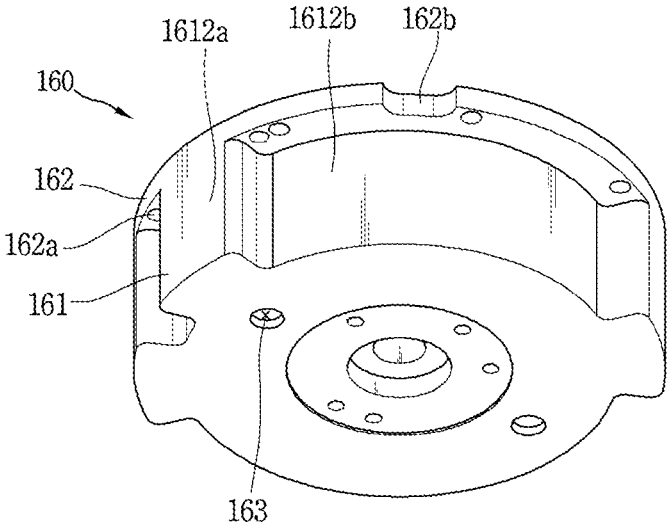
FIG. 5 is a perspective view illustrating a discharge cover of FIG. 2.
Figure 6:
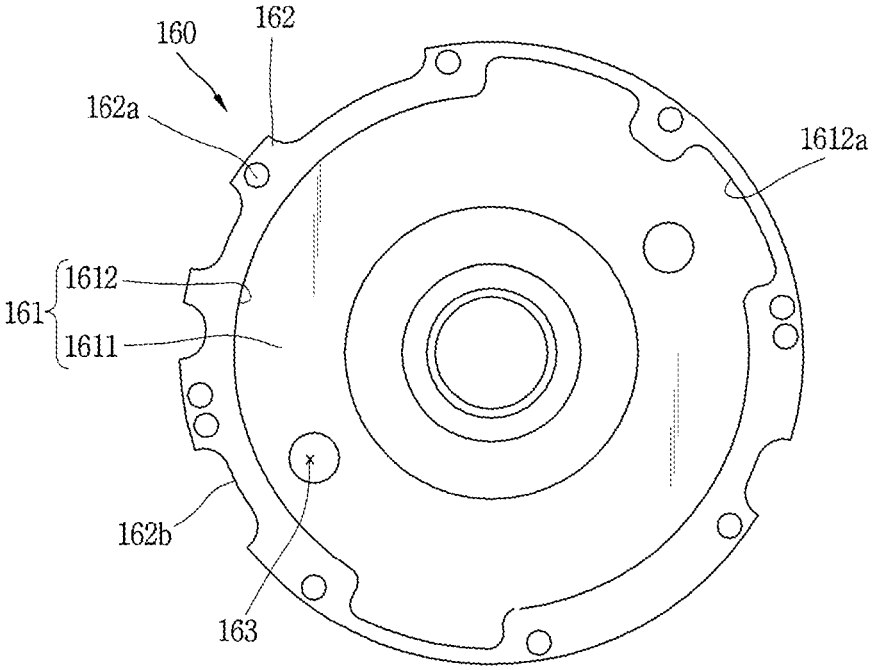
FIG. 6 is a planar view illustrating the discharge cover of FIG. 2.

Hereinafter, the compression unit of FIG. 2 will be described in more detail with reference to FIGS. 3 and 4.

As described above, the compression unit may include the main frame 130, the orbiting scroll 150, the fixed scroll 140, and the discharge cover 160.

First, the main frame 130 will be described.

The main frame 130 may include a frame end plate 131, a frame side wall portion 132, a main bearing portion 133, a scroll accommodating portion 134, and a scroll supporting portion 135.

The frame end plate 131 may be formed in an annular shape.

The frame side wall portion 132 may extend downward in a cylindrical shape from an edge of a lower surface of the frame end plate 131.

An outer circumferential surface of the frame side wall portion 132 may be fixed to the inner circumferential surface of the cylindrical shell 111 in a shrink-fitting manner or a welding manner.

Accordingly, a space above the frame end plate 131 may be isolated. That is, the lower space S1 may be defined above the frame end plate 131.

A plurality of frame discharge holes 132*a* may be formed through the frame side wall portion 132 in a vertical (up/down) direction.

The plurality of frame discharge holes 132*a* may be formed at positions to be aligned with positions of scroll discharge holes 142*a* of the fixed scroll 140 to be described later. Accordingly, when the main frame 130 and the fixed scroll 140 are coupled to each other, the frame discharge holes 132*a* may communicate with the scroll discharge holes 142*a* so as to form refrigerant discharge flow paths.

In addition, a plurality of frame oil recovery grooves 132*b* may be formed on the outer circumferential surface of the frame side wall portion 132 with the frame discharge holes 132*a* interposed therebetween.

The plurality of frame oil recovery grooves 132*b* may be disposed at preset intervals along the circumferential direction. Accordingly, when the main frame 130 and the cylindrical shell 111 are coupled to each other, the plurality of frame oil recovery grooves 132*b* may define predetermined spaces, which have upper and lower sides open, together with the inner circumferential surface of the cylindrical shell 111.

The frame oil recovery grooves 132*b* may be formed at positions corresponding to positions of scroll oil recovery grooves 142*b* of the fixed scroll 140 to be described later. Accordingly, when the main frame 130 and the fixed scroll 140 are coupled to each other, the frame oil recovery grooves 132*b* may define oil recovery flow paths together with the scroll oil recovery grooves 142*b* of the fixed scroll 140.

The main bearing portion 133 may protrude upward from an upper surface of a central part of the frame end plate 131 toward the driving motor 120.

A main bearing hole 133*a* may be formed in a cylindrical shape through the main bearing portion 133 in the axial direction.

A main bearing 171 may be fixedly inserted into the inner circumferential surface of the main bearing hole 133*a*.

The main bearing portion 133 of the rotating shaft 125 may be inserted into the main bearing 171 to be supported in the radial direction.

The scroll accommodating portion 134 may be formed as a space defined (surrounded) by an inner circumferential surface of the frame side wall portion 132 and a lower surface of the frame end plate 131.

The orbiting scroll 150 to be described later may be accommodated in the scroll accommodating portion 134 so as to perform an orbiting motion. To this end, an inner diameter of the frame side wall portion 132 may be greater than an outer diameter of an orbiting end plate 151 to be described later.

In addition, the frame side wall portion 132 defining the scroll accommodating portion 134 may have a height (depth) that is greater than or equal to a thickness of the orbiting end plate 151. Accordingly, while the frame side wall portion 132 is supported on the upper surface of the fixed scroll 140, the orbiting scroll 150 may perform the orbiting motion in the scroll accommodating portion 134.

The scroll supporting portion 135 may be formed in an annular shape on the lower surface of the frame end plate 131 that faces the orbiting end plate 151 of the orbiting scroll 150 to be described later. Accordingly, an Oldham ring 180 may be pivotably inserted between an outer circumferential surface of the scroll supporting portion 135 and the inner circumferential surface of the frame side wall portion 132.

In addition, the scroll supporting portion 135 may have a lower surface formed to be flat, so that a back pressure sealing member 1515 provided on the orbiting end plate 151 of the orbiting scroll 150 to be described later is in contact with the lower surface in a sliding manner.

The back pressure sealing member 1515 may be formed in an annular shape, so as to define an oil accommodating portion 155 in a space between the scroll supporting portion 135 and the orbiting end plate 151.

Hereinafter, the fixed scroll 140 will be described.

The fixed scroll 140 may include a fixed end plate 141, a fixed side wall portion 142, a sub bearing portion 143, and a fixed wrap 144.

The fixed end plate 141 may be formed in a disk shape having a plurality of concave (recessed) portions formed on an outer circumferential surface thereof.

The fixed side wall portion 142 may extend in an annular shape from an edge of an upper surface of the fixed end plate 141 in the vertical direction.

The fixed side wall portion 142 may be coupled to face the frame side wall portion 132 of the main frame 130 in the vertical direction.

A plurality of scroll discharge holes 142*a* may be formed through the frame side wall portion 142 in the vertical direction.

The plurality of scroll discharge holes 142*a* may communicate with the frame discharge holes 132*a* in a state in which the fixed scroll 140 is coupled to the cylindrical shell 111.

Scroll oil recovery grooves 142*b* may be formed on an outer circumferential surface of the fixed side wall portion 142.

In addition, the fixed side wall portion 142 provided with a suction through hole 142*c* that penetrates through the fixed side wall portion 142 in the radial direction.

An end portion of the refrigerant suction pipe 115 inserted through the cylindrical shell 111 may be inserted into the suction through hole 142*c*. Accordingly, the refrigerant may be introduced into a compression chamber through the refrigerant suction pipe 115.

A sub bearing portion 143 may extend from a central part of the fixed end plate 141 toward the discharge cover 160 in the axial direction. Therefore, the lower end of the rotating shaft 125 may be inserted into the sub bearing portion 143 to be supported in the radial direction, and the eccentric portion 1254 of the rotating shaft 125 may be supported by the upper surface of the fixed end plate 141 defining the surrounding of the sub bearing portion 143 in the axial direction.

The fixed wrap 144 may extend from the upper surface of the fixed end plate 141 toward the orbiting scroll 150 in the axial direction.

The fixed wrap 144 may be engaged with an orbiting wrap 152 to be described later to define a compression chamber. A detailed description of this will be given later together with a description of the orbiting wrap 152.

Hereinafter, the orbiting scroll 150 will be described.

The orbiting scroll 150 may include an orbiting end plate 151, an orbiting wrap 152, and a rotating shaft coupling portion 153.

The orbiting end plate 151 may be formed in a disk shape.

A back pressure sealing groove 151*a* into which the back pressure sealing member 1515 is inserted may be formed on an upper surface of the orbiting end plate 151.

The back pressure sealing groove 151*a* may be formed in an annular shape to surround the rotating shaft coupling portion 153 to be described later, and may be formed eccentrically with respect to a central axis of the rotating shaft coupling portion 153. Accordingly, even if the orbiting scroll 150 performs an orbiting motion, a back pressure chamber having a constant range may be defined between the orbiting scroll 150 and the scroll support portion 135 of the main frame 130.

Further, a compression chamber oil supply hole 156, which will be described later, may be formed at the orbiting end plate 151.

One end of the compression chamber oil supply hole 156 may communicate with the oil accommodating portion 155, and another end may communicate with an intermediate pressure chamber of the compression chamber. Accordingly, oil stored in the oil accommodating portion 155 may be supplied into the compression chamber through the compression chamber oil supply hole 156 to lubricate the compression chamber.

Specifically, the compression chamber oil supply hole 156 may include a first compression chamber oil supply hole 1561 and a second compression chamber oil supply hole 1562. One end of the first compression chamber oil supply hole 1561 and one end of the second compression chamber oil supply hole 1562 may communicate with the oil accommodating portion 155, respectively, and another end of the first compression chamber oil supply hole 1561 and another end of the second compression chamber oil supply hole 1562 may communicate with a first compression chamber and a second compression chamber, respectively. A detailed description of this will be given later together with a description of the oil accommodating portion 155.

The orbiting wrap 152 may extend from a lower surface of the orbiting end plate 151 toward the fixed scroll 140.

The orbiting wrap 152 may be engaged with the fixed wrap 144 to define a compression chamber.

The compression chamber may include a first compression chamber defined between an inner surface of the fixed wrap 144 and an outer surface of the orbiting wrap 152 based on the fixed wrap 144, and a second compression chamber defined between an outer surface of the fixed wrap 144 and an inner surface of the orbiting wrap 152 based on the fixed wrap 144.

The orbiting wrap 152 may be formed in an involute shape together with the fixed wrap 144. However, the orbiting wrap 152 and the fixed wrap 144 may alternatively be formed in various shapes other than the involute shape.

An inner end of the orbiting wrap 152 may be formed on a central part of the orbiting end plate 151.

In addition, the rotating shaft coupling portion 153 may be formed through the central part of the orbiting end plate 151 in the axial direction.

The eccentric portion 1254 of the rotating shaft 125 may be rotatably inserted into the rotating shaft coupling portion 153. Therefore, an outer circumference of the rotating shaft coupling portion 153 may be connected to the orbiting wrap 152 to define the compression chamber together with the fixed wrap 144 during a compression process.

The rotating shaft coupling portion 153 may be formed at a height at which it overlaps the orbiting wrap 152 on the same plane. That is, the rotating shaft coupling portion 153 may be formed at a height at which the eccentric portion 1254 of the rotating shaft 125 overlaps the orbiting wrap 152 on the same plane.

Accordingly, a repulsive force of a refrigerant and a compressive force may be offset from each other while being applied to the same plane based on the orbiting end plate 151. This may result in preventing the orbiting scroll 150 from being inclined due to the action of the compressive force and the repulsive force.

An eccentric portion bearing 173 may be coupled to an inner circumferential surface of the rotating shaft coupling portion 153 in an inserting manner.

The eccentric portion 1254 of the rotating shaft 125 may be rotatably inserted into the eccentric portion bearing 173. Accordingly, the eccentric portion 1254 of the rotating shaft 125 may be supported by the eccentric portion bearing 173 in the radial direction, so as to smoothly perform an orbiting motion with respect to the orbiting scroll 150.

The oil accommodating portion 155 may be formed in the rotating shaft coupling portion 153, and the oil accommodating portion 155 may communicate with the compression chamber oil supply hole 156 that is formed through the orbiting end plate 151 in the radial direction.

The oil accommodating portion 155 may be formed at an upper side of the eccentric portion bearing 173.

Hereinafter, the discharge cover 160 will be described.

The discharge cover 160 may include a cover housing portion 161, a cover flange portion 162, a muffler hole 163, and a refrigerant guide member 164.

The cover housing portion 161 may include a cover bottom surface 1611 and a cover side portion 1612.

The cover housing portion 161 may form a cover space part 161*a* defining a discharge space S4 together with the fixed scroll 140. Specifically, the cover bottom surface 1611 and the cover side portion 1612 may form the cover space part 161*a* defining the discharge space S4 together with the surface of the fixed scroll 140 inserted therein.

A through hole may be formed through a central part of the cover bottom surface 1611 in the axial direction, and the sub bearing portion 143 that protrudes downward from the fixed end plate 141 may be inserted into the through hole.

The cover bottom surface 1611 may be spaced apart from the inner circumferential surface of the casing 110. Specifically, the cover bottom surface 1611 may be spaced apart from the lower shell 113. At this time, the oil storage space S3 may be defined between the cover bottom surface 1611 and the inner circumferential surface of the casing 110.

The cover side portion 1612 may be formed in an annular shape by extending from the cover bottom surface 1611 toward the fixed scroll 140 in the axial direction.

The cover side portion 1612 may extend outward from an outer circumferential surface of the cover housing portion 161 so as to be coupled to the lower surface of the fixed scroll 140 in a close contact manner.

In addition, at least one discharge guide groove 1612*a* may be formed on an inner circumferential surface of the cover side portion 1612 along the circumferential direction.

The discharge guide groove 1612*a* may refer to a portion of the cover side portion 1612 that is recessed radially outwardly.

A space that is recessed radially toward the outside of the cover side portion 1612 due to the formation of the discharge guide groove 1612*a* may overlap the scroll discharge hole 142*a* of the fixed scroll 140 in the vertical direction.

An inner surface of the cover side portion 1612 excluding the discharge guide groove 1612*a* may be brought into close contact with the outer circumferential surface of the fixed scroll 140, namely, the outer circumferential surface of the fixed end plate 141 so as to form a type of sealing portion.

Side oil recovery grooves 1612*b* may be formed on an outer circumferential surface of the cover side portion 1612 at preset intervals along the circumferential direction.

The cover flange portion 162 may extend in a radial direction from an outer circumferential surface of the cover side portion 1612 except for a portion where the discharge guide groove 1612*a* is formed. Specifically, the cover flange portion 162 may extend from the outer circumferential surface of an upper side of the cover side portion 1612.

Coupling holes 162*a* for coupling the discharge cover 160 to the fixed scroll 140 with bolts may be formed through the cover flange portion 162.

A plurality of flange oil recovery grooves 162*b* may be formed between the coupling holes 162*a* at preset intervals along the circumferential direction.

The flange oil recovery grooves 162*b* may be recessed radially inwardly (toward the center) from an outer circumferential surface of the cover flange portion 162.

Meanwhile, a muffler hole 163 and a refrigerant guide member 164 may be provided on a lower side of the discharge cover 160, and a detailed description thereof will be described later.

Hereinafter, the discharge cover 160 of FIGS. 2 to 4 will be described in more detail with reference to FIGS. 5 to 10.

The muffler hole 163 may be formed through a part of the discharge cover 160. In this case, the part may be located on any one of the cover bottom surface 1611, a connection portion 1613 between the cover bottom surface 1611 and the cover side portion 1612, and the cover side portion 1612.

As described above, the muffler hole 163 may communicate with the discharge space S4 and the oil storage space S3. Accordingly, a refrigerant collected in the discharge space S4 may partially flow into the oil storage space S3 through the muffler hole 163.

The muffler hole 163 may extend in one of the same direction as the extending direction of the casing 110, a direction different from the extending direction of the casing 110, and a radial direction of the cover side portion 1612.

The muffler hole 163 may not be limited to the illustrated shape, and may be formed in various shapes and sizes. For example, the muffler hole 163 may be formed in a manner that polygonal cross sections extend in a predetermined direction.

In one implementation, the muffler hole 163 may be formed such that a circular cross section having a diameter of 0.5 mm or more extends in a predetermined direction.

In addition, the single discharge cover 160 may be provided with a plurality of muffler holes 163 spaced apart from each other.

When the number and size of the muffler hole 163 increases, an amount of refrigerant flowing into the oil storage space S3 may also increase. However, in the case, there may be a problem that an Oil Circulation Ratio (OCR) also increases.

Therefore, the number and size of the muffler hole 163 must be adjusted according to a preset operation condition and the OCR. Accordingly, the scroll compressor 10 may be operated at an OCR optimized for a preset operation condition.

Hereinafter, the muffler hole 163 will be described in more detail with reference to implementations of the present disclosure.

In the implementation illustrated in FIGS. 5 to 8, the muffler hole 163 may be formed through the cover bottom surface 1611. At this time, the muffler hole 163 may be disposed between an outer circumference of the oil feeder 127 and an outer circumference of the cover bottom surface 1611.

Figure 7A:
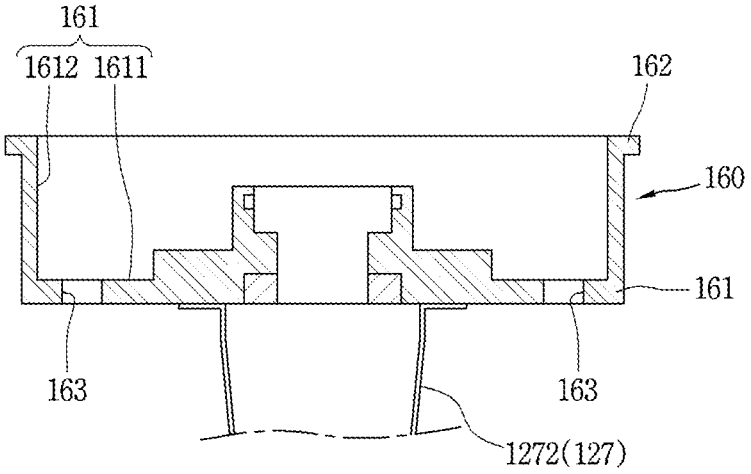
FIGS. 7A and 7B are sectional views illustrating a discharge cover in accordance with one implementation of the present disclosure.
Figure 7B:
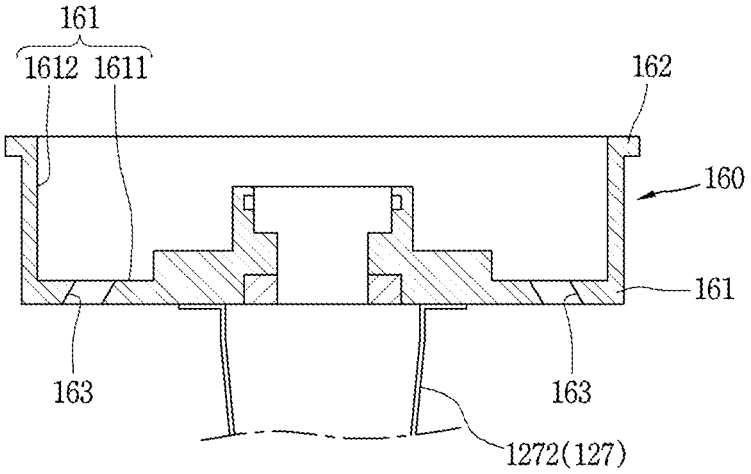

In the implementation illustrated in FIG. 7A, the muffler hole 163 may extend in the same direction as the direction that the casing 110 extends. In the implementation illustrated in FIG. 7B, the muffler hole 163 may extend in a direction different from the direction that the casing 110 extends.

Figure 9:
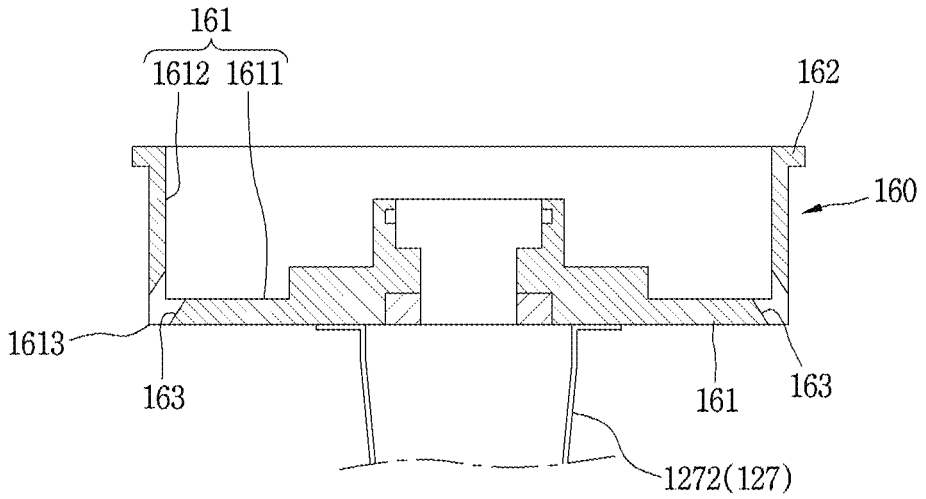
FIG. 9 is a sectional view illustrating a discharge cover in accordance with still another implementation of the present disclosure.
Figure 10:
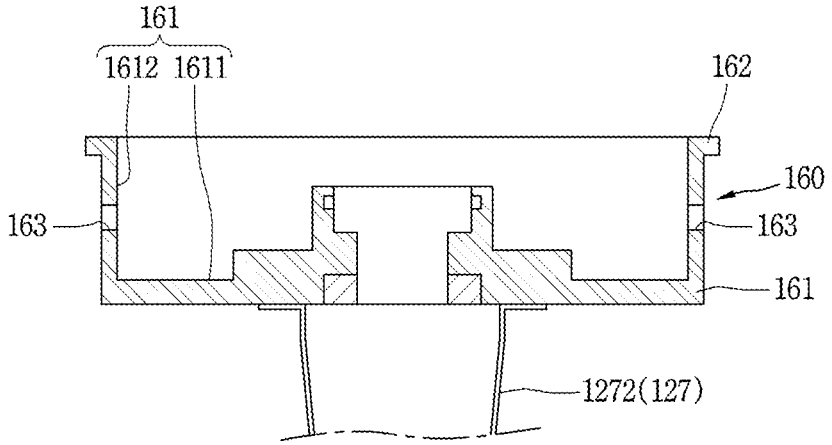
FIG. 10 is a sectional view illustrating a discharge cover in accordance with still another implementation of the present disclosure.

In another implementation illustrated in FIG. 9, the muffler hole 163 may be formed through a connection portion between the cover bottom surface 1611 and the cover side portion 1612.

In another implementation illustrated in FIG. 9, the muffler hole 163 may be formed through a connection portion 1613 between the cover bottom surface 1611 and the cover side portion 1612.

In this case, the muffler hole 163 may extend in the radial direction of the cover side portion 1612. However, although not illustrated, the muffler hole 163 may extend in a direction different from the direction that the casing 110 extends.

A refrigerant discharged through the muffler hole 163 may collide with the refrigerant guide member 164 and then flow into the oil storage space S3.

Figure 8:
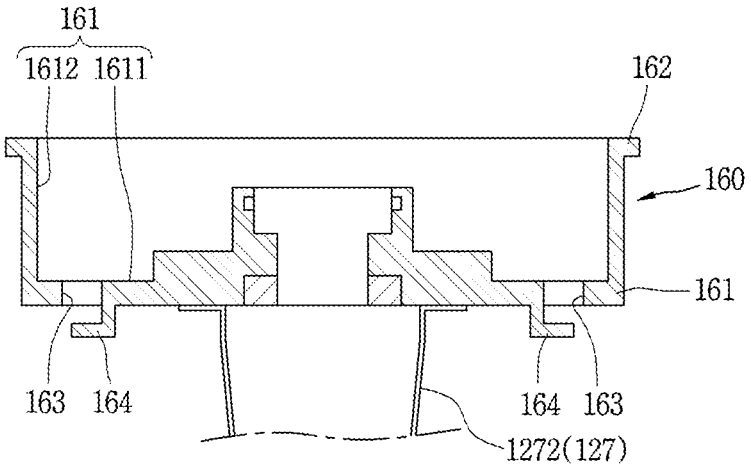
FIG. 8 is a sectional view illustrating a discharge cover in accordance with another implementation of the present disclosure.

Hereinafter, the refrigerant guide member 164 will be described with reference to FIG. 8.

The refrigerant guide member 164 may guide the flow of the refrigerant discharged through the muffler hole 163.

The refrigerant guide member 164 may be disposed on a part of the discharge cover 160 adjacent to the muffler hole 163. In one implementation, the refrigerant guide member 164 may be disposed on one side of the cover bottom surface 1611, which is opposite to the fixed scroll 140. In another implementation, the refrigerant guide member 164 may be disposed on the outer circumferential surface of the cover side portion 1612.

Further, the refrigerant guide member 164 may extend in a predetermined direction to guide the flow of the refrigerant in the predetermined direction. In one implementation, the predetermined direction may be a direction toward the oil storage space S3. In another implementation, the predetermined direction may be the same as the direction that the muffler hole extends. In another implementation, the predetermined direction may be a direction different from the direction that the muffler hole extends. In another implementation, the predetermined direction may be the radial direction of the cover side portion 1612.

In addition, the refrigerant guide member 164 may extend in the extending direction of the muffler hole 163 to overlap the muffler hole 163.

Accordingly, the refrigerant passing through the muffler hole 163 may collide with the refrigerant guide member 164 and then be guided in the extending direction of the refrigerant guide member 164 to flow into the oil storage space S3.

The refrigerant guide member 164 may not be limited to the illustrated shape, and may be formed in various shapes. For example, the refrigerant guide member 164 may extend by being curved in a predetermined direction.

Hereinafter, movement paths of oil and refrigerant when the scroll compressor 10 is operated will be described in more detail.

Figure 2:
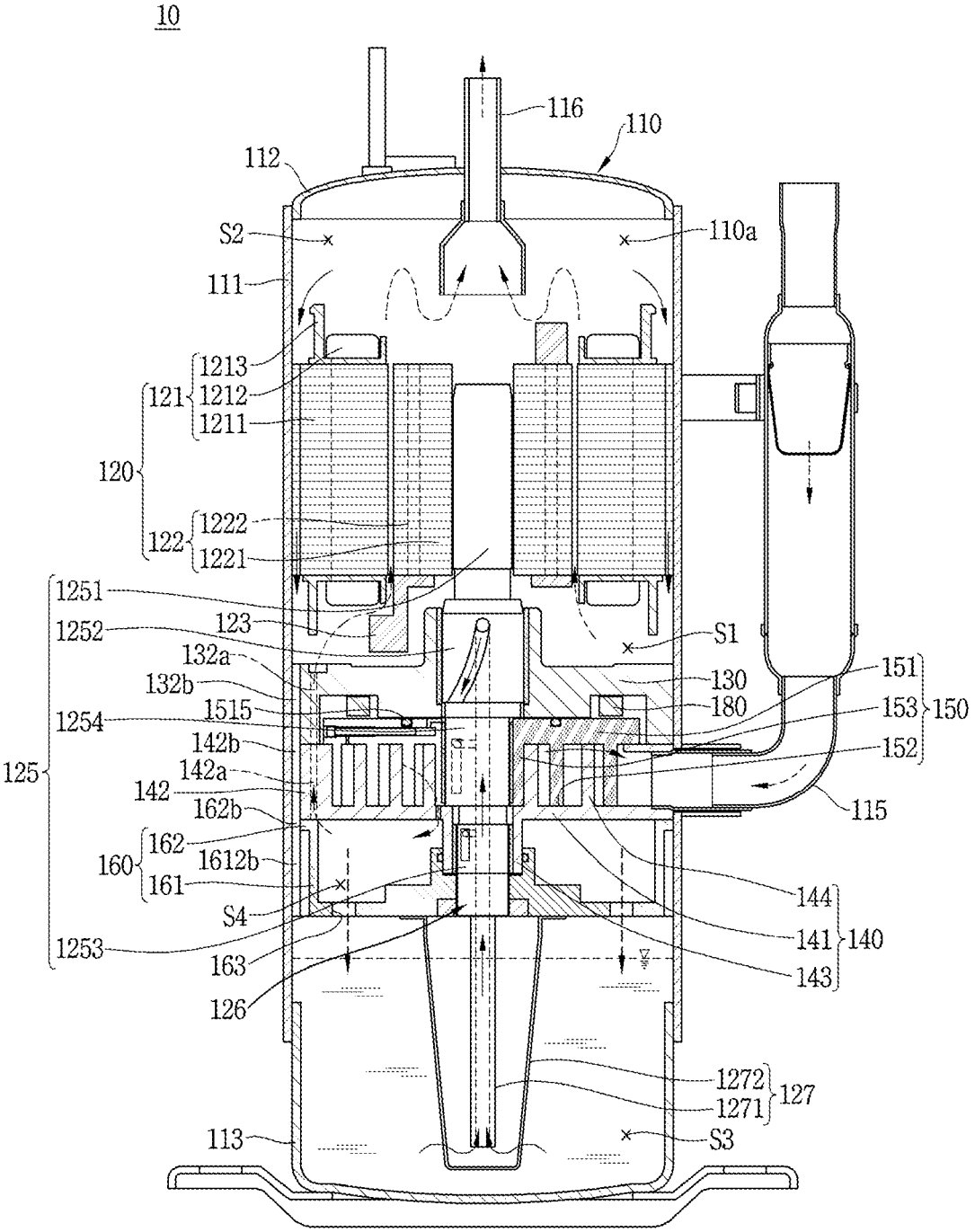
FIG. 2 is a sectional view illustrating the scroll compressor of FIG. 1.

Solid arrows in the drawing may indicate the movement path of the oil, and dotted arrows may indicate the movement path of the refrigerant (see FIG. 2).

In the related art scroll compressor 10, after flowing into the refrigerant suction pipe 115, the refrigerant may sequentially flow along the compression chamber, the discharge space S4, the fixed scroll 140, the main frame 130, the driving motor 120, and the upper space S2, so as to be discharged through the refrigerant discharge pipe 116.

First, when the scroll compressor 10 is initially operated, the refrigerant may be introduced through the refrigerant suction pipe 115. Specifically, the refrigerant may be sucked into the compression chamber through the refrigerant suction pipe 115.

The refrigerant introduced in the compression chamber may be compressed by the orbiting motion of the orbiting scroll 150 and discharged into the discharge space S4.

The refrigerant in the discharge space S4 may move up along the discharge guide groove 1612*a* formed on the inner circumferential surface of the discharge cover 160, and flow into the lower space S1 sequentially via the fixed scroll 140 and the main frame 130.

Specifically, the refrigerant may flow into the lower space S1 sequentially via the scroll discharge hole 142*a* of the fixed scroll 140 and the frame discharge hole 132*a* of the main frame 130.

The refrigerant in the lower space S1 may reach the upper space S2 via the driving motor 120. Specifically, the refrigerant in the lower space S1 may move up along a space between the stator 121 and the rotor 122 and reach the upper space S2.

Finally, the refrigerant which has reached the upper space S2 may be discharged to the outside of the scroll compressor 10 through the refrigerant discharge pipe 116.

While the refrigerant flows along the movement path, oil may circulate in a manner of flowing into the oil storage space S3, sequentially passing through the compression chamber, the upper space S2, and the lower space S1, and flowing back into the oil storage space S3.

Hereinafter, the movement path of the oil will be described in more detail.

First, oil may be supplied from the oil storage space S3 to the compression chamber through the oil feeder 127 and the oil supply passage 126.

The oil supplied to the compression chamber may flow to the upper space S2 together with the refrigerant, and flow down into the lower space S1 through a space between the stator core 1211 and the cylindrical shell 111.

The oil that has flowed down into the lower space S1 may sequentially pass through the main frame 130 and the fixed scroll 140 so as to be discharged to the oil storage space S3.

Specifically, the oil may sequentially pass through the frame oil recovery groove 132*b* of the main frame 130 and the scroll oil recovery groove 142*b* of the fixed scroll 140, to be discharged into the oil storage space S3.

At this time, in the scroll compressor 10 according to the present disclosure, the refrigerant collected in the discharge space S4 may partially flow into the oil storage space S3 through the muffler hole 163. More specifically, a part of the refrigerant collected in the discharge space S4 may pass through the muffler hole 163 and collide with the refrigerant guide member 164, so as to be introduced into the oil storage space S3.

The remaining refrigerant may then flow into the upper space S2 sequentially via the fixed scroll 140, the main frame 130 and the driving motor 120.

Accordingly, the refrigerant can be brought into direct contact with the oil in the oil storage space S3 and stirred with the oil. At this time, the refrigerant may be compressed in the compression chamber to be increased in temperature, and then introduced into the oil storage space S3 in the temperature-increased state.

Accordingly, at the beginning of the operation of the scroll compressor 10, the temperature of the oil in the oil storage space S3 may increase more rapidly. That is, a time for the oil temperature inside the oil storage space S3 to reach a predetermined temperature may be further reduced.

Low-temperature oil has low viscosity and may not exhibit a lubrication effect sufficiently. Therefore, when the oil of the low temperature is supplied to the compression unit, problems of damaging bearings and lowering an oil level may occur.

However, when the oil temperature inside the oil storage space S3 is rapidly increased, the oil can be prevented from being supplied to the compression unit in a low viscosity state. This may also result in preventing damage on bearings and lowering of an oil level.

In addition, as the oil inside the oil storage space S3 is directly stirred with the refrigerant, the oil temperature inside the oil storage space S3 can be adjusted without using a separate pipe branched from a refrigerant pipe.

Accordingly, the structure of the scroll compressor 10 can be more simplified, and the manufacturing process can be further reduced.

In addition, production and maintenance costs of the scroll compressor 10 can be reduced.

Although the foregoing description has been given with reference to the preferred implementations, but the present disclosure may not be limited to the described implementations.

In addition, it will be understood that various changes and modifications can be made without departing from the scope and range of the present disclosure described in the following claims by those skilled in the art to which the present disclosure pertains.

Further, the embodiments may be configured by selectively combining all or part of each of the embodiments so that various modifications may be made.

What is claimed is:

1. A scroll compressor comprising:

a fixed scroll;

an orbiting scroll disposed at a first side of the fixed scroll and configured to perform an orbiting motion relative to the fixed scroll and define a compression chamber between the orbiting scroll and the fixed scroll;

a discharge cover disposed at a second side of the fixed scroll that is opposite to the first side of the fixed scroll; and a casing extending in a first direction and accommodating the fixed scroll, the orbiting scroll, and the discharge cover, wherein the discharge cover comprises:

a cover bottom surface, a cover side portion extending from the cover bottom surface toward the fixed scroll, and a discharge space defined by the cover bottom surface, the cover side portion, and the fixed scroll, wherein the cover bottom surface and an inner circumferential surface of the casing are spaced apart from each other and define an oil storage space between the cover bottom surface and the casing, wherein the cover bottom surface defines a muffler hole that is in fluid communication with the discharge space and the oil storage space, wherein the cover bottom surface is coupled with an oil feeder at a side of the cover bottom surface that is opposite to the fixed scroll, the oil feeder extending away from the fixed scroll, and wherein the muffler hole is disposed between an outer circumference of the oil feeder and an outer circumferential surface of the cover bottom surface.

2. The scroll compressor of claim 1, wherein the muffler hole extends in the first direction.

3. The scroll compressor of claim 2, further comprising a refrigerant guide disposed at a side of the cover bottom surface that is opposite to the fixed scroll and adjacent to the muffler hole, the refrigerant guide extending in the first direction to overlap the muffler hole and configured to cause a refrigerant passing through the muffler hole to contact the refrigerant guide.

4. The scroll compressor of claim 1, wherein the muffler hole extends in a second direction different from the first direction.

5. The scroll compressor of claim 4, further comprising a refrigerant guide disposed at a side of the cover bottom surface that is opposite to the fixed scroll and adjacent to the muffler hole, the refrigerant guide extending in the second direction to overlap the muffler hole and configured to cause a refrigerant passing through the muffler hole to contact with the refrigerant guide.

6. The scroll compressor of claim 1, wherein the muffler hole has a circular cross section that extends in a predetermined direction, the circular cross section having a diameter of 0.5 mm or greater.

7. The scroll compressor of claim 1, wherein the cover bottom surface defines the muffler hole further comprising a plurality of muffler holes that are spaced apart from each other.

* * * * *